US008721396B1

(12) United States Patent
Martin et al.

(10) Patent No.: US 8,721,396 B1
(45) Date of Patent: May 13, 2014

(54) METHOD FOR PREPARING AND BUFFING A POWDER COATED WOOD SUBSTRATE

(71) Applicant: BTD Wood Powder Coating, Inc., Brainerd, MN (US)

(72) Inventors: Craig A. Martin, Hugo, MN (US); Craig Fast, Big Lake, MN (US); Clint Ellenberg, Dallas, TX (US)

(73) Assignee: BTD Wood Powder Coating, Inc., Brainerd, MN (US)

( * ) Notice: Subject to any disclaimer, the term of this patent is extended or adjusted under 35 U.S.C. 154(b) by 0 days.

(21) Appl. No.: 13/795,782

(22) Filed: Mar. 12, 2013

(51) Int. Cl.
*B24B 37/04* (2012.01)

(52) U.S. Cl.
USPC ..... 451/57; 451/28; 451/58

(58) Field of Classification Search
CPC ..... B24B 37/042; B24B 7/228; B24B 21/04; B24B 27/0076
USPC ..... 451/57, 28, 58, 44, 66; 427/180–371
See application file for complete search history.

(56) References Cited

U.S. PATENT DOCUMENTS

| | | | | | |
|---|---|---|---|---|---|
| 3,090,695 | A * | 5/1963 | Orth, Jr. | 427/289 |
| 3,125,461 | A * | 3/1964 | Hoffman | 427/289 |
| 3,480,456 | A * | 11/1969 | Forkner | 427/4 |
| 4,541,466 | A * | 9/1985 | Stegherr | 144/363 |
| H244 | H * | 4/1987 | Goodwin | 451/57 |
| 5,620,751 | A * | 4/1997 | Brindoepke et al. | 427/506 |
| 5,708,039 | A * | 1/1998 | Daly et al. | 521/61 |
| 5,714,206 | A * | 2/1998 | Daly et al. | 427/475 |
| 5,743,789 | A * | 4/1998 | Russell | 451/57 |
| 6,086,461 | A * | 7/2000 | Williams et al. | 451/65 |
| 6,146,252 | A * | 11/2000 | Martensson | 451/44 |
| 6,268,022 | B1 * | 7/2001 | Schlegel et al. | 427/471 |
| 6,859,988 | B2 * | 3/2005 | Lovchik et al. | 29/558 |
| 6,887,516 | B2 | 5/2005 | Krysa et al. | |
| 7,205,027 | B2 | 4/2007 | Brosemer | |
| 7,275,979 | B2 * | 10/2007 | Raynauld | 451/11 |
| 7,290,759 | B1 * | 11/2007 | Lavrencik | 267/140.2 |
| 7,649,034 | B2 | 1/2010 | Ladatto et al. | |
| 7,971,551 | B2 | 7/2011 | Mauchle et al. | |
| 8,088,452 | B2 | 1/2012 | Hwang et al. | |
| 8,088,855 | B2 | 1/2012 | Hwang et al. | |
| 8,329,258 | B2 | 12/2012 | Seitz | |
| 8,372,478 | B1 | 2/2013 | Harris et al. | |
| 8,591,617 | B2 | 11/2013 | Landgraf | |
| 8,597,735 | B2 | 12/2013 | Inoue et al. | |
| 2003/0054740 | A1 * | 3/2003 | Mansky | 451/57 |
| 2003/0148026 | A1 * | 8/2003 | Mushett et al. | 427/180 |
| 2003/0194554 | A1 * | 10/2003 | Petersen et al. | 428/402 |
| 2004/0235391 | A1 * | 11/2004 | Grivna | 451/5 |

(Continued)

OTHER PUBLICATIONS

Application and File History for U.S. Appl. No. 13/795,600, filed Mar. 12, 2013, inventor Craig A. Martin.

*Primary Examiner* — George Nguyen
(74) *Attorney, Agent, or Firm* — Patterson Thuente Pedersen, P.A.

(57) ABSTRACT

The invention includes a method for preparing and buffing an item made of powder coated MDF (or other substrate containing wood) with the end result of improved visual and tactile smoothness; the invention includes the steps of cutting and machining the part, pre-powder preparation and sanding of the part, powder coating the part, post-powder preparation and sanding, and buffing the part. This method of sanding and buffing results in a smoother finish than is currently available in any other powder coated MDF finish while requiring less coats than similar liquid paint finishes.

19 Claims, 17 Drawing Sheets

(56) References Cited

U.S. PATENT DOCUMENTS

| | | | | |
|---|---|---|---|---|
| 2005/0034785 | A1* | 2/2005 | Lovchik et al. | 144/356 |
| 2007/0099551 | A1* | 5/2007 | Walsh | 451/523 |
| 2007/0157994 | A1* | 7/2007 | Scoville et al. | 144/380 |
| 2008/0233300 | A1* | 9/2008 | Cinoman et al. | 427/386 |
| 2009/0047480 | A1* | 2/2009 | Juers et al. | 428/172 |
| 2009/0071941 | A1 | 3/2009 | Knoblauch et al. | |
| 2009/0192247 | A1* | 7/2009 | Daly et al. | 524/81 |

* cited by examiner

Pre-Powder Coating Sanding Steps for Part Faces and Edges, Preferred Embodiment

| | |
|---|---|
| Step 1 | 220 grit aluminum oxide, silicon carbide, 3M Trizact, or the equivalent |
| Step 2 | 280 grit aluminum oxide, silicon carbide, 3M Trizact, or the equivalent |
| Step 3 | 320 grit aluminum oxide, silicon carbide, 3M Trizact, or the equivalent |

FIGURE 14

Post-Powder Coating Sanding Steps for Part Edges Using Profile Sander, Preferred Embodiment

Step 1 400 grit aluminum oxide anti-static open coat
Step 2 30μ grit aluminum oxide or silicon carbide anti-static open coat
Step 3 20μ grit aluminum oxide or silicon carbide anti-static open coat

Post-Powder Coating Sanding Steps for Part Faces, Preferred Embodiment

Step 1 P320 grit aluminum oxide anti-static open coat wide belt veneer segmented platen sander, Cross Belt Finish Technology
Step 2 P500 grit aluminum oxide anti-static open coat wide belt veneer segmented platen sander, Cross Belt Finish Technology
Step 3 30μ grit aluminum oxide anti-static open coat wide belt veneer segmented platen sander, Cross Belt Finish Technology
Step 4 30μ grit aluminum oxide or silicon carbide anti-static open coat wide orbital sander
Step 5 20μ grit aluminum oxide or silicon carbide anti-static open coat wide orbital sander
Step 5 15μ grit aluminum oxide or silicon carbide anti-static open coat wide orbital sander
*Feed speed of 18 feet per minute with a belt speed of 1400 feet per minute on the open coat wide belt.

Post-Powder Sanding Steps for Part Edges Using Random Orbital Sander

Step 1 30μ grit aluminum oxide or silicon carbide anti-static open coat
Step 2 20μ grit aluminum oxide or silicon carbide anti-static open coat
Step 3 15μ grit aluminum oxide or silicon carbide anti-static open coat
*In this preferred embodiment, a 3/16" random orbital sander is used

FIGURE 15

Face Buffing Equipment, Preferred Embodiment

| Equipment or Supply Name | Equipment Brand and Properties |
|---|---|
| Rubbing Compound | 3M Brand 06060 Perfect-it 3000 Extra Cut Rubbing Compound |
| Buffer | Rotary buffer with speed of 1800 revolutions per minute |
| Buffing Pad | 3M Brand 82531 Finesse-it Buffing Pad |
| Polish | 3M Brand Finesse-it Extra Fine Polish |
| Polishing Pad | 3M Brand 05725 Perfect-it Foam Polishing Pad |

FIGURE 16

Edge Buffing Equipment, Preferred Embodiment

| Equipment or Supply Name | Equipment Brand and Properties |
|---|---|
| Rubbing Compound | 3M Brand 06060 Perfect-it 3000 Extra Cut Rubbing Compound |
| Buffer | 3M Brand 08125 Air Buffing Tool |
| Buffing Pad | Orange, with foam construction |
| Polish | 3M Brand Finesse-it Extra Fine Polish |
| Polishing Pad | 3M Brand 05725 Perfect-it Foam Polishing Pad |

FIGURE 17

METHOD FOR PREPARING AND BUFFING A POWDER COATED WOOD SUBSTRATE

FIELD OF THE INVENTION

The invention relates to a method of powder coating materials. More specifically, the invention relates to a process of taking a part made of powder coated MDF (or other substrate containing wood) and preparing it to accept a buffing treatment, with the end goal of enhancing the final smoothness of finish.

BACKGROUND OF THE INVENTION

Powder coating is a type of coating that is applied as a free-flowing, dry powder. The main difference between a conventional liquid paint and a powder coating is that the powder coating is stored as a solid and does not need to be kept in a liquid form (using such liquids as a water base or solvent) in order to keep the binder and filler particles in suspension. The coating is typically applied electrostatically and is then cured under heat to allow it to flow and form a "skin" around all or part of the substrate. The powder may be a thermoplastic, thermoset, or a UV polymer. It is usually used to create a hard finish that is tougher than conventional paint. Powder coating is mainly used for coating of metals, such as household appliances, aluminum extrusions, and automobile and bicycle parts. Newer technologies allow other materials, such as MDF (medium-density fiberboard) to be powder coated using different methods. There are several advantages of powder coating over conventional liquid coatings:

1. Powder coatings emit zero or near zero volatile organic compounds (VOC).
2. Powder coatings can produce much thicker coatings in one coat than conventional liquid coatings without running or sagging.
3. Powder coating overspray can be recycled and thus it is possible to achieve nearly 100% use of the coating.
4. Powder coating production lines typically produce less hazardous waste than conventional liquid coatings.
5. A wide range of specialty effects is easily accomplished which would be impossible to achieve with other coating processes.

While powder coatings have many advantages over other coating processes, there are some disadvantages to the technology. Although the powder is relatively easy to apply in a single thick coating, a single powder coat is not as smooth as a similarly thick liquid paint finish; however, to achieve a similarly thick liquid paint finish it is necessary to apply multiple coats with sanding between each coat. Furthermore, the application of multiple powder coats serves to further increase the thickness of the coating, but does not reliably enhance the visual or tactile smoothness of the powder coated finish.

Many manufacturers of powder coated MDF have taken various steps in the past in order to improve the smoothness of the finish. Methods include:

1. Varying the preheat and cure temperature settings
2. Additional pre-coating sanding, both manual and automated
3. Installation of infrared heaters or UV curing lights at various points in the powder coating line
4. Reformulation of powder used in the coating process
5. Polyester versus epoxy base of the powder coating (chemistry adjustments)
6. Increased fineness of powder grind 7. Repeated sifting of powder during formulation
8. Automated versus hand spraying and measurement of application The aforementioned methods have indeed resulted in incrementally increased smoothness relative to previously existing methods. Employing any or all of these methods, however, results in a maximum surface smoothness in the 4-6 range on the PCI scale.

In such industries as furniture and cabinetry, there is growing demand for increasingly smooth finishes. Traditionally, this demand has been met through such finishes as laminates, veneers, vinyl wraps, or liquid paints. These traditional finishes have their own shortcomings and powder coated MDF is frequently a more desirable choice for durability or part design needs. Furthermore, powder coated MDF is free of HAPs, VOCs, and PVCs, some or all of which are contained in many traditional wood finishes. Nonetheless, it is not currently possible to achieve similar smoothness in powder coated MDF finishes regardless of content or steps.

Therefore, there exists a need for a method of preparing and buffing an item made of powder coated MDF in order to enhance visual and tactile smoothness.

SUMMARY OF THE INVENTION

The invention relates to a method for preparing and buffing an item made of powder coated MDF in order to enhance visual and tactile smoothness. Compared with untreated powder coated MDF, the resulting finish is significantly smoother than other known powder coated finishes.

The invention includes the steps of cutting and machining the part, pre-powder preparation and sanding of the part, powder coating the part, post-powder preparation and sanding, and buffing the treated part.

The idea of buffing powder coated MDF in order to enhance surface smoothness is novel and is not known to have been employed before this discovery; further, it results in a smoothness rating in the range of 9-10 on the PCI scale, a smoothness that is not currently attainable with existing powder coated MDF finishes. The applicant knows of no attempts to treat the surface of a powder coated wood part in any way after coating with the ultimate goal of increasing surface smoothness.

In one embodiment, the invention includes a method for treating a powder coated part to enhance visual and tactile smoothness. The method comprising the steps of obtaining a part that is fabricated from a substrate containing wood, cutting and machining the part to a desired size utilizing equipment that has a tolerance that is less than +/−0.030", pre-powder preparation and sanding of the part by utilizing a sander to smooth the faces and edges of the part, whereby the sander has a Y-axis tolerance of less than 0.003", and wherein the edges are sanded to a minimum radius of 1/32" (0.8 mm), powder coating the part, post-powder preparation and sanding of the part to a PCI smoothness of at least 6 using an abrasive, buffing the part to achieve a PCI smoothness of at least 7.

In another embodiment, the invention includes a method for treating a powder coating a part to enhance visual and tactile smoothness comprising the steps of obtaining a part that is fabricated from medium-density fiberboard, cutting and machining the part to a desired size utilizing equipment that has a tolerance that is less than +/−0.030", pre-powder preparation and sanding of the part by utilizing a sander to smooth the faces and edges of the part, whereby the sander has a Y-axis tolerance of less than 0.003", and wherein the edges are sanded to a minimum radius of 1/32" (0.8 mm), and wherein the part is first sanded with a 220 grit aluminum oxide, silicon carbide media, then sanded with a 280 grit aluminum oxide, silicon carbide media, then sanded with a 320 grit aluminum oxide, silicon carbide media, powder coating the part, whereby the part is heated to a temperature between 150 and 350 degrees Fahrenheit to create an electrostatic charge, wherein powder is applied to the part and the part is then allowed to cure, resulting in a part that is coated with at least 5 mils of coverage about its surfaces and edges, post-powder preparation and sanding of the part using an abrasive having a minimum grit size of 15μ, whereby the edges of the part are sanded and whereby the faces of the part are sanded to a PCI smoothness of at least 7, and buffing the part; whereby the part has a PCI smoothness of at least 7.

In yet another embodiment, the invention includes a powder coated article having enhanced visual and tactile smoothness. The article comprises a substrate containing wood, a surface coating with PCI smoothness of at least 6 formed by the process of cutting and machining the part to a desired size utilizing equipment that has a tolerance that is less than +/−0.030", pre-powder preparation and sanding of the part by utilizing a sander to smooth the faces and edges of the part, whereby the sander has a Y-axis tolerance of less than 0.003", and wherein the edges are sanded to a minimum radius of 1/32" (0.8 mm), powder coating the part, whereby the part is coated with at least 5 mils of coverage about its surfaces and edges, post-powder preparation and sanding of the part using an abrasive, and whereby the edges of the part are sanded and whereby the faces of the part are sanded to a PCI smoothness of at least 6, buffing the part using a rotary buffer with a speed of 1800 revolutions per minute.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which:

FIG. 14 illustrates the ideal abrasive grit sequences for pre-powder coating sanding in the preferred embodiment of the invention;

FIG. 15 illustrates the ideal post-powder coating abrasive grit sequences for faces and edges of the part in the preferred embodiment of the invention;

FIG. 16 illustrates the ideal face buffing equipment utilized in the preferred embodiment of the invention; and FIG. 17 illustrates the ideal edge buffing equipment utilized in the preferred embodiment of the invention.

DETAILED DESCRIPTION OF THE PREFERRED EMBODIMENTS

The invention relates to a method for preparing and buffing an item made of powder coated MDF in order to enhance visual and tactile smoothness. Compared with untreated powder coated MDF, the resulting finish is significantly smoother than existing known methods:

1. Untreated powder coated MDF is able to achieve a PCI smoothness of 4-6.
2. Top coated over untreated powder coated MDF is able to achieve a PCI smoothness of 4-6.
3. Buffed untreated powder coated MDF is able to achieve a PCI smoothness of 4-6
4. Top coated over treated powder coated MDF is able to achieve a PCI smoothness of 8-10.
5. Treated and buffed powder coated MDF is able to achieve a PCI smoothness of 9-10, without the need to apply a final liquid top coat For the purposes of this application, "smoothness" refers to the visual detectability of smoothness or lack of "orange peel" in a finished surface. ACT Test Panels Inc. manufacturers the PCI smoothness scale for powder coated finishes. This scale is commonly employed by a wide variety of industries to compare visual smoothness of painted finishes. The scale ranges from 1-10, with 1 being a heavy texture and 10 being completely smooth (glass-like). For the purposes of this application, "failure" is meant to describe a situation resulting in a less-than-ideal finish. Failures can include situations such as sanding through the coating to the bare substrate, or a final smoothness that is less than PCI 9-10; PCI 9-10 is a smoothness range which is higher than is currently attainable with any other existing untreated powder coated MDF finish. For the purposes of this application, "untreated" refers to a standard powder coated MDF part that has not been modified in any way after the standard coating has been applied. "Treated" refers to powder coated MDF parts that have received the additional steps outlined in this application.

Figure 13:
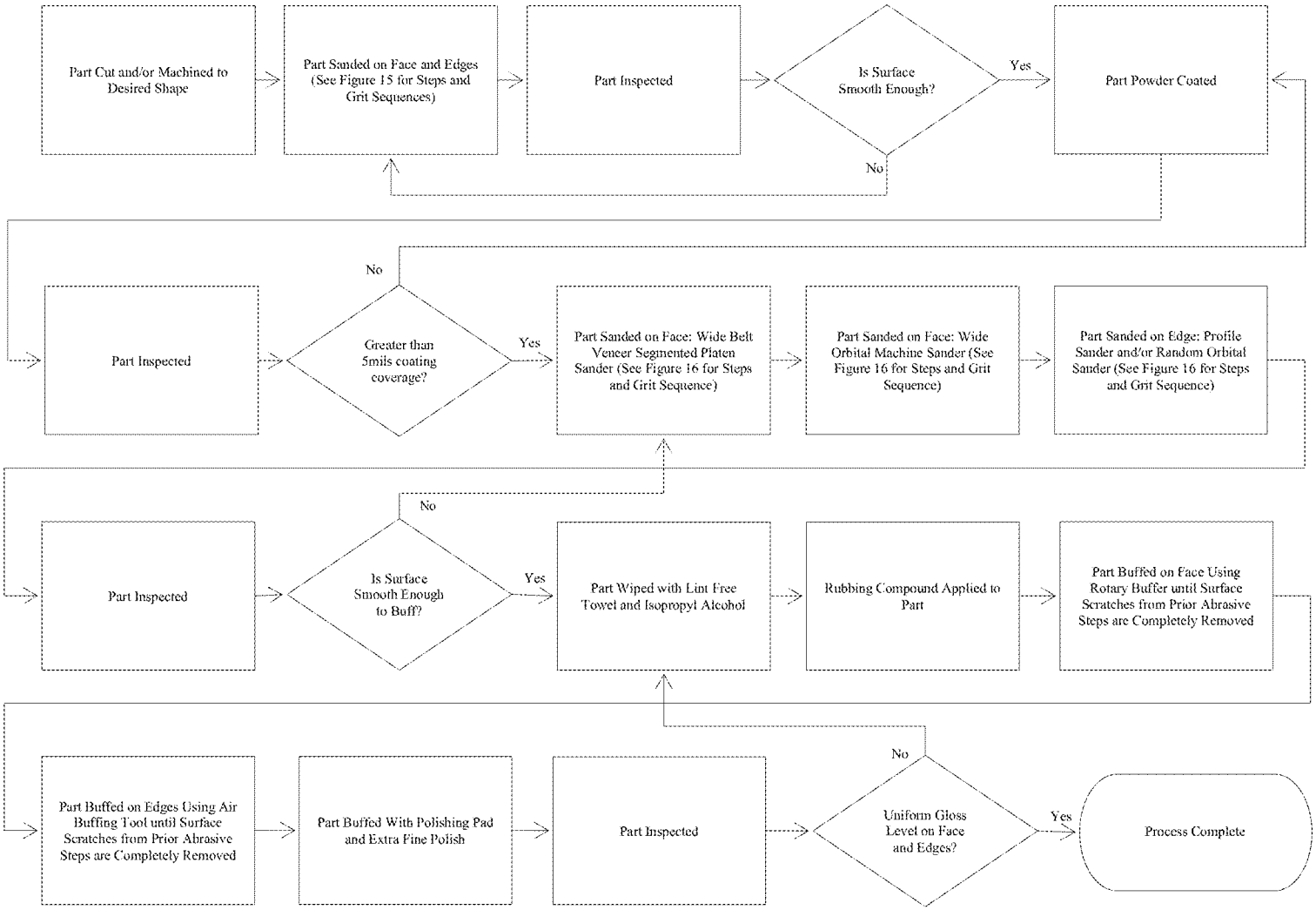
FIG. 13 illustrates the process steps and decision points in accordance with the present invention.

The overall process and decision points involved in the present invention is shown in FIG. 13. However, there are five basic steps in the process of the present invention. First, the part is machined and cut to the desired size. Second, the part receives a pre-powder preparation and sanding. Third, the part undergoes a powder coating process. Fourth, the part undergoes post-powder preparation and sanding. Lastly, the part undergoes a buffing process. With respect to the process of the present invention, the preferred substrate is MDF; however, similar results can be achieved with the process described on other substrates with wood content (such as high density fiberboard). Therefore, other substrates containing wood could be used while remaining within the scope of the invention.

Figure 1:
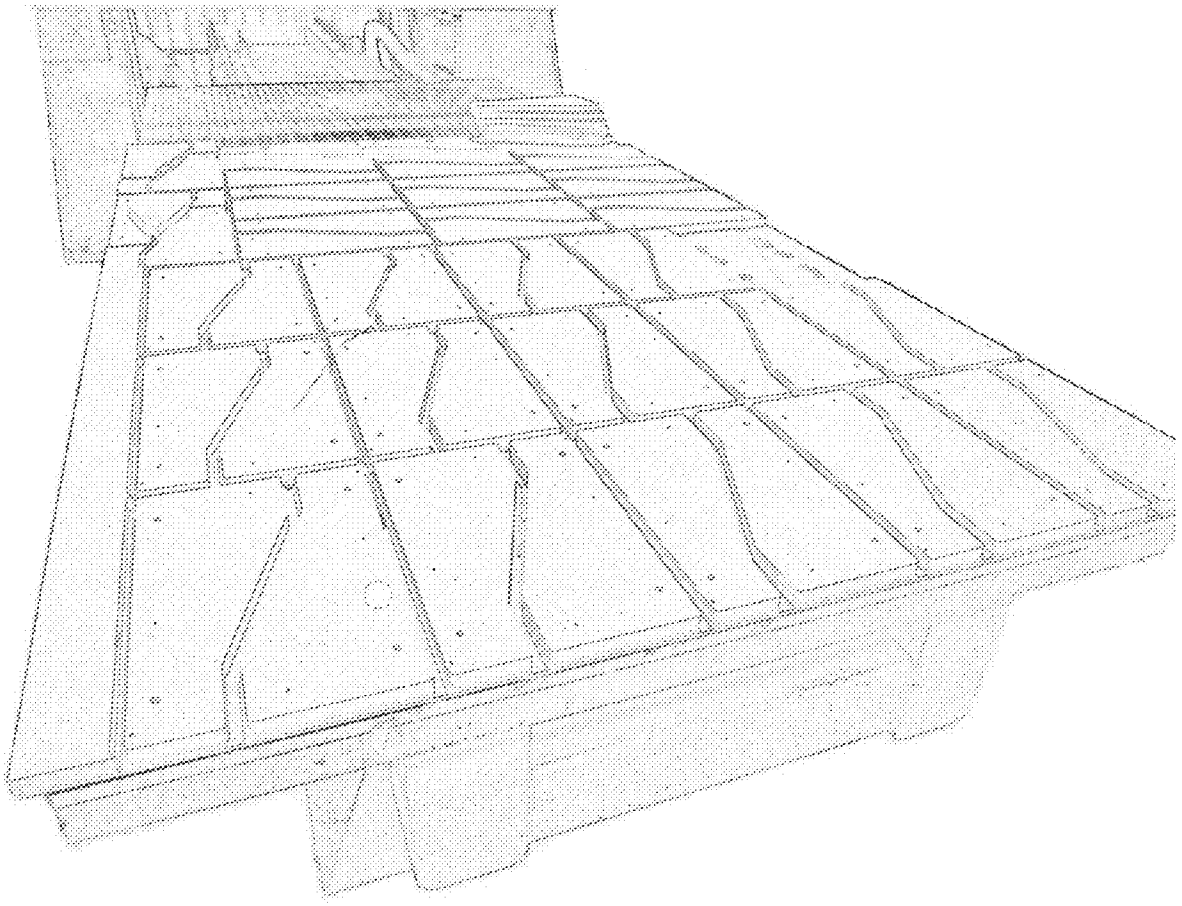
FIG. 1 illustrates MDF parts that have been cut on a CNC router machine.

The first step of cutting and machining the part will now be discussed. In this step, MDF components are machined (cut to drawn shapes and designs) from purchased sheet stock in powder coat grade, available from a variety of milling operations. MDF sheet brands and thicknesses are variable and are not critical to this process. Machining operations generally utilize such equipment as CNC routers, CNC point-to-point drilling/milling equipment, through feed molding machines, shapers, hand routers, panel saws, sliding table saws, and fixed table saws. The parts to be coated can be any shape designed from flat sheet material, provided the design fits within tolerances and parameters outlined herein. FIG. 1 illustrates MDF parts cut on a CNC router.

Success of the sanding, preparation, coating, and post-coating processes is dependent on the initial quality of the machining "Quality of Machining" is defined as:

- In a preferred embodiment, the tolerance of the equipment cutting the profile is less than +/−0.030"
  - Any cuts outside of tolerance will result in a part that is larger or smaller than expected in certain places. This means that, during the post-powder sanding process, there is a risk of sanding through the powder coat to the raw wood substrate. This would result in a failure of the part, as the part would be rendered useless.
- In a preferred embodiment, tooling for this process is in new condition
  - Tooling is the equipment that actually makes the cuts in the wood. It is optimal that the tooling is in new condition so that it is as sharp and accurate as possible. Otherwise, inconsistent cuts will result and uneven sanding can increase the chance of part failure.
- In a preferred embodiment, the tooling is constructed of solid carbide or high speed steel
  - Solid carbide and high speed steel tooling is sharper than standard diamond tooling, resulting in a smoother and more reliable cut. Smoother, more reliable cuts result in a more even surface and decrease the chance or part failure during post-powder sanding.
  - Standard diamond tooling is less preferred because it is generally not sharp enough to reliably achieve similar smoothness of cut required for successful finishing without imperfections from fiber pop. Fiber pop is a failure wherein the fibers of the boards "pop up" during heating, resulting in an uneven surface and increasing the chance of part failure during post-powder sanding. Although standard diamond tooling could theoretically be used, it increases the likelihood of part failure.

Figure 2:
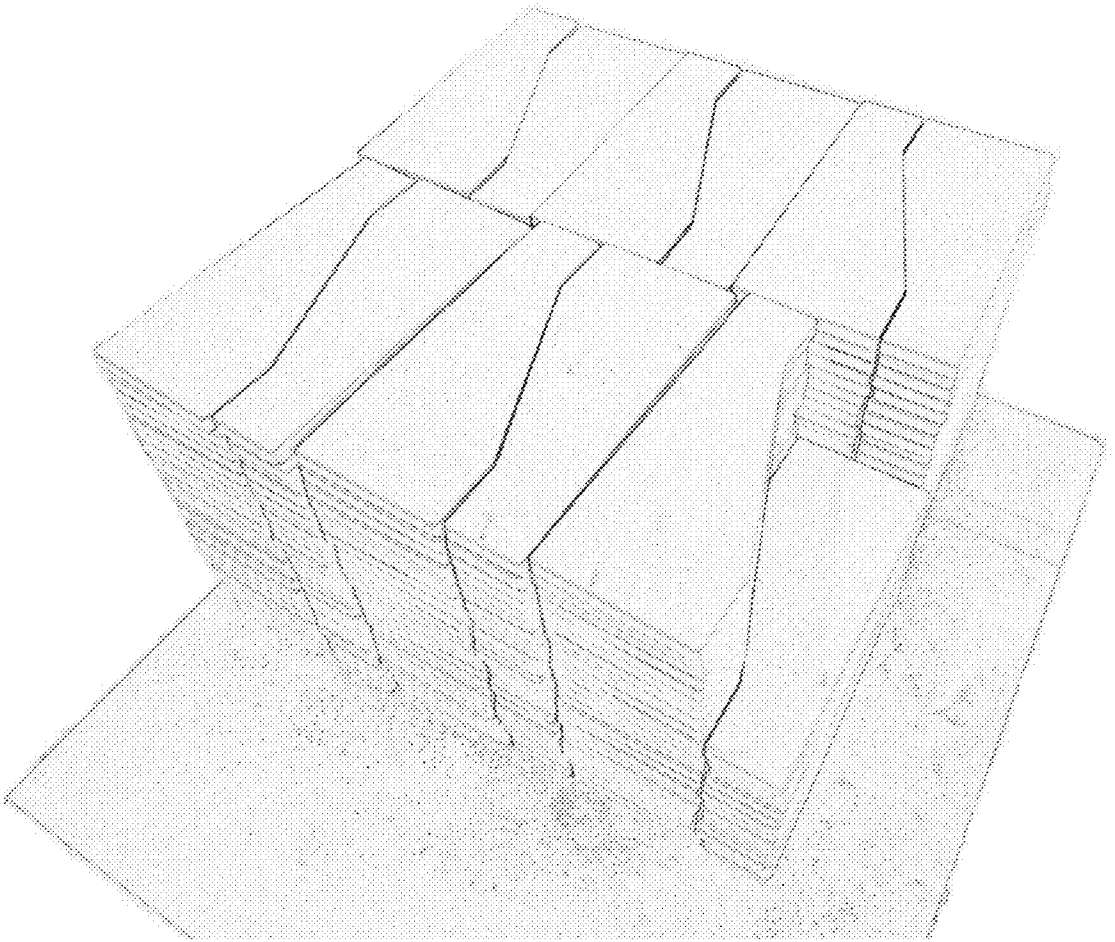
FIG. 2 illustrates MDF parts that have received the pre-powder coating preparation and sanding steps according to the invention.

The second step of pre-powder coating preparation and sanding will now be discussed. The face and edge preparation treatments are important to the final quality and appearance of the finished parts and should be considered as part of this invention; this step is material to the invention because omission of the step can leave surface irregularities and contamination on the surface of the board to be coated. These irregularities are subsequently covered by the powder coating but can then be exposed when sanding after powder coating. The result is an increased probability of sanding through to the surface contamination, demonstrating visible speckling or color irregularity and resulting in a part failure. Parts that have been appropriately sanded as described are illustrated in FIG. 2.

In this pre-powder coating preparation and sanding step, the part faces are sanded using a wide belt sander, a wide belt veneer segmented platen sander, a wide orbital machine sander, a random orbital hand sander, or a combination of this sanding (or other surface smoothing) equipment. Grit types and sizes can vary based upon the abrasive manufacturer and the equipment being utilized. The edges are prepared in a similar manner with like grit materials using machine edge sanding equipment utilizing belts, disks, profiled sanding heads or other proprietary sanding techniques specific to the machine manufacturer and dictated by suitability with shape of part being sanded. The specific abrasive material, manufacturer, and equipment is not critical and can be varied while remaining within the scope of the invention.

Figure 12:
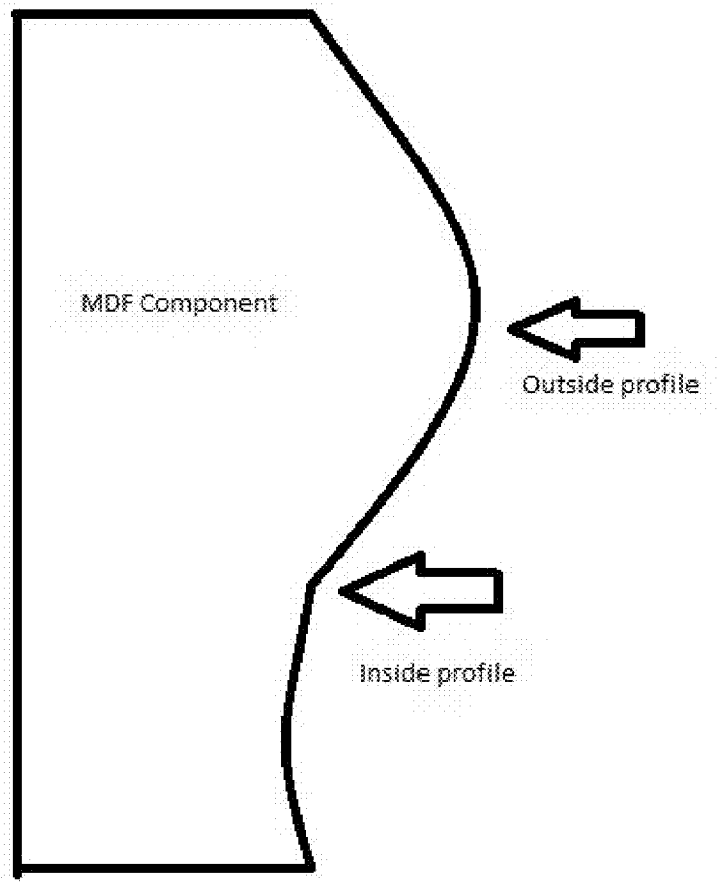
FIG. 12 illustrates examples of inside and outside radii on a powder coated MDF part, of which a similarly shaped actual part is shown in FIGS. 1 and 2.

The following steps should ideally be taken to ensure proper pre-powder coating part preparation:

- In a preferred embodiment, abrasive grit sequence is applied in accordance with the grit sequence table set forth in FIG. 14.
- In a preferred embodiment, automated edge sanding machines should have a Y-axis tolerance of less than 0.003" to avoid sanding through the powder coated base finish
- In a preferred embodiment, manual (hand) sanding equipment should be held flat (parallel) to the surface being sanded in order to avoid sanding through the powder coated base finish.
- In a preferred embodiment, edges generally should not be designed with deeply machined profiles, as it is generally necessary for sanding equipment to reach all parts of the face and edges to achieve uniform quality of finish. Deeply machined profiles are difficult to reach with sanding equipment, increasing the probability that an area of the part is left without being sanded. Regions of the part that are not sanded can result in a finish that is less than optimal and that has a higher potential part failure rate. Specific depth parameters depend upon the sanding equipment being applied, but it is necessary for the entire part to be sanded, otherwise the final buffing result will be less than optimal.
- In a preferred embodiment, edges of the components should preferably have a minimum radius of 1/32" (~0.8 mm) to avoid "burning through" the edges with sanding equipment.
- In a preferred embodiment, inside profiles (also known as radii) should be designed to accommodate for edge machine sanding capabilities. FIG. 12 depicts examples of inside and outside radii. These specific radii criteria are dependent on the type of edge sanding equipment milling stations available or chosen at machine purchase.
  - This parameter is important because the part should be properly sanded in all areas to receive the final buffing step The step of powder coating the MDF substrate will now be discussed. There are a variety of known methods to powder coat components machined from MDF. The overall process described herein can be applied to known powder coated MDF finishes in general, regardless of basic powder coating method used. A powder coated MDF finish can be obtained by heating the substrate to a consistent temperature in order to create an electrostatic charge, applying the powder, and allowing it to cure. Alternately, UV can be used to coat via a UV-cured powder coating process while remaining within the scope of the invention. As previously described, the method of powder coating is not critical to the overall invention described herein. The preferred embodiment in these step is that surfaces and edges should optimally have at least 7-8 mils of coating coverage; otherwise, post coating sanding may sand through the coating, exposing the raw wood substrate and resulting in a failure.

A main reason why powder coating is critical to the process of the present invention is that powder coating results in a thicker coating per coat on a wood substrate than liquid paints. Furthermore, the powder coated finish is harder than that of a liquid paint, so it can be sanded more consistently without "burning through" the coating. It is theoretically possible that 5-8 mils of paint thickness could be achieved using a liquid paint, but it would require multiple base coats—in many cases, at least 4-6 base coats. Comparatively, powder coatings with a thickness of 5-8 mils can routinely be achieved using a one-pass (one coat) powder coat process.

The step of post-powder preparation and sanding of the coated part will now be discussed. After the powder coat is applied, it is optimal to follow specific steps of the sanding process as described herein in order to achieve the desired finish. This is one of the most critical aspects of the entire process of the present invention.

Figure 7:
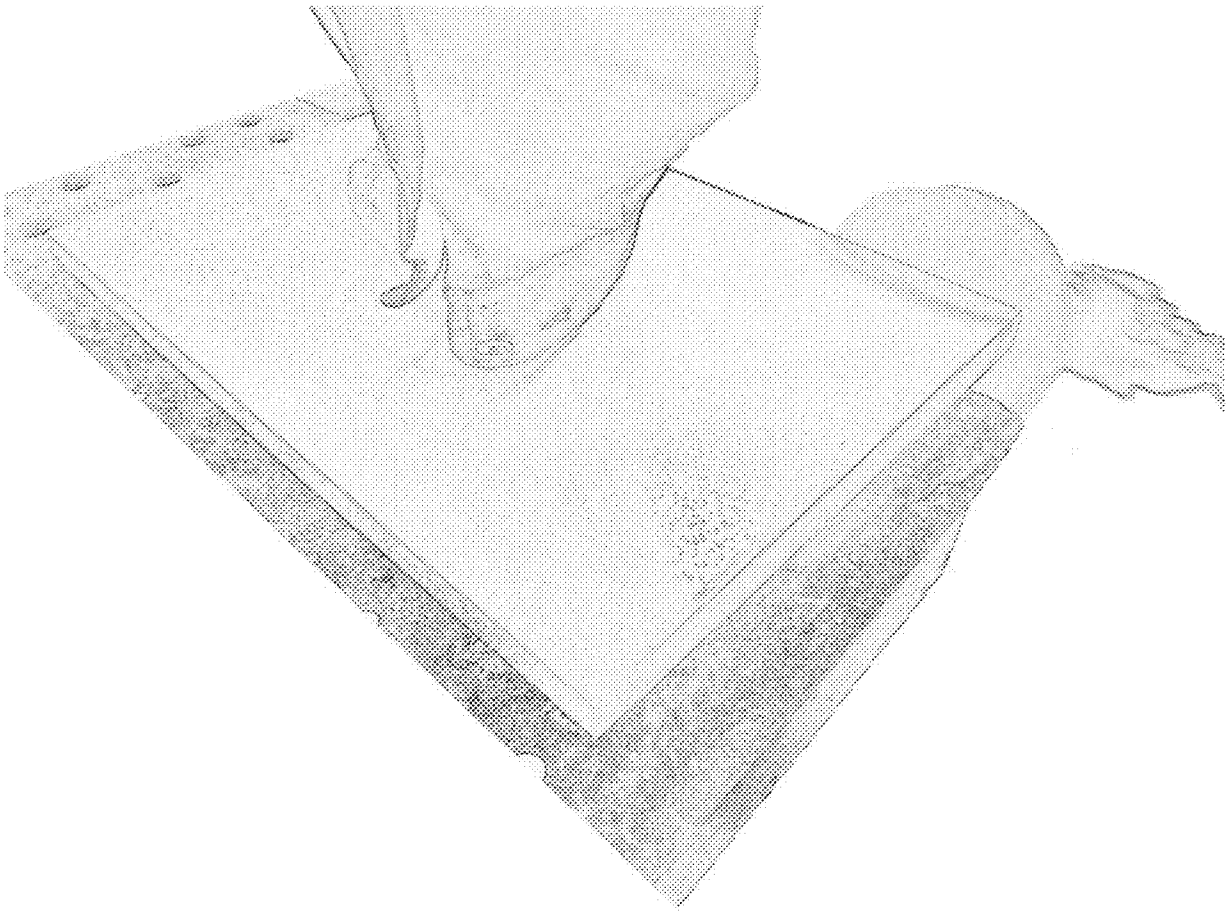
FIG. 7 illustrates a view of sanding the edge of the part with a random orbital hand sander in accordance with one embodiment of the invention.

In the preferred embodiment of this post-powder sanding step, the edges of the part are sanded first, as demonstrated in FIG. 7. The edge sanding equipment used is variable and based upon the shape of the edge profile. In a preferred embodiment, a profile sander is utilized in accordance with grit sequences set forth in FIG. 15 for the corresponding equipment. Successful testing has been conducted as well using a random orbital sander in accordance with the grit sequences set forth in FIG. 15 for the corresponding equipment.

Figure 3:
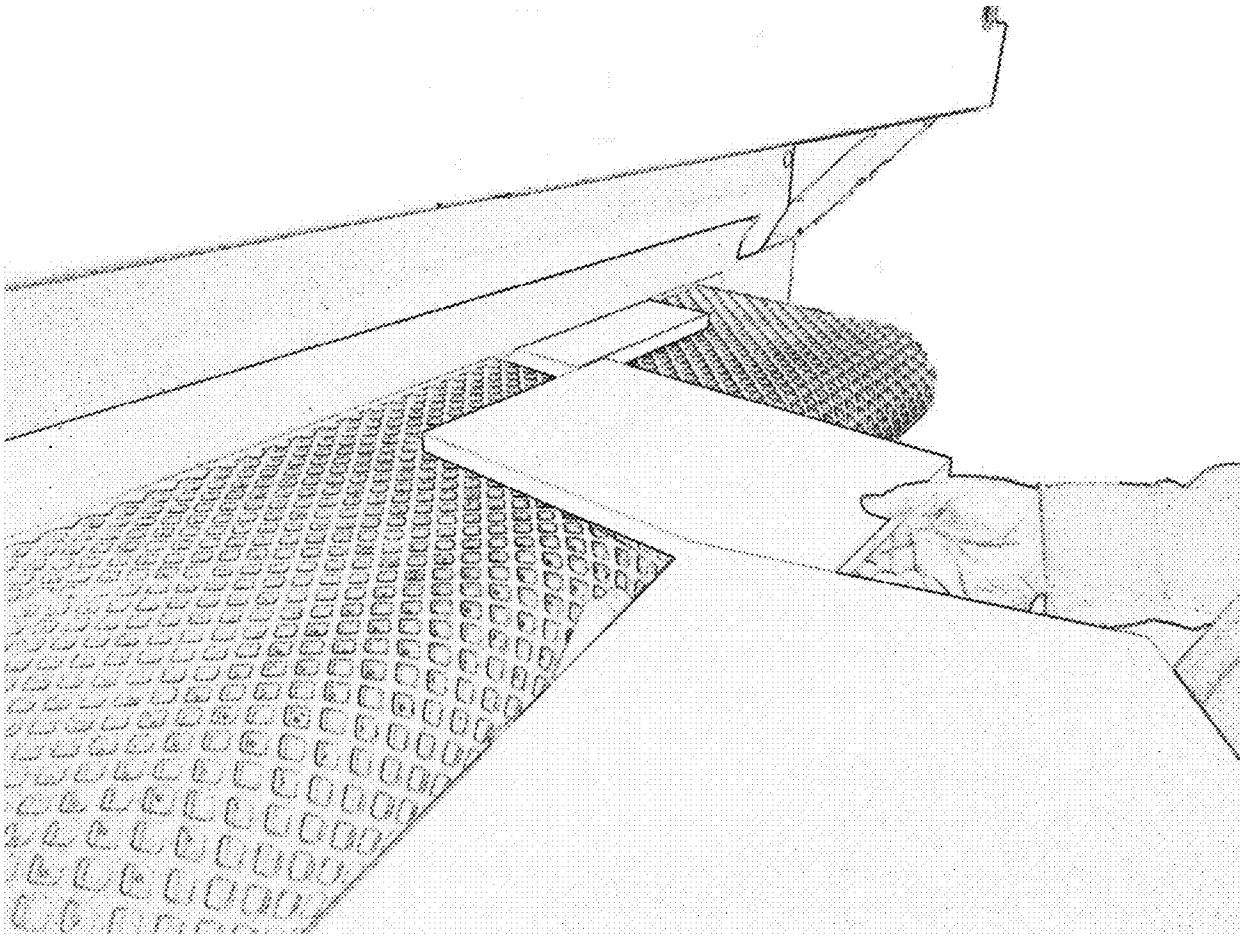
FIG. 3 illustrates the step of inserting the powder coated part into the wide belt veneer segmented platen sander according to the invention.
Figure 6:
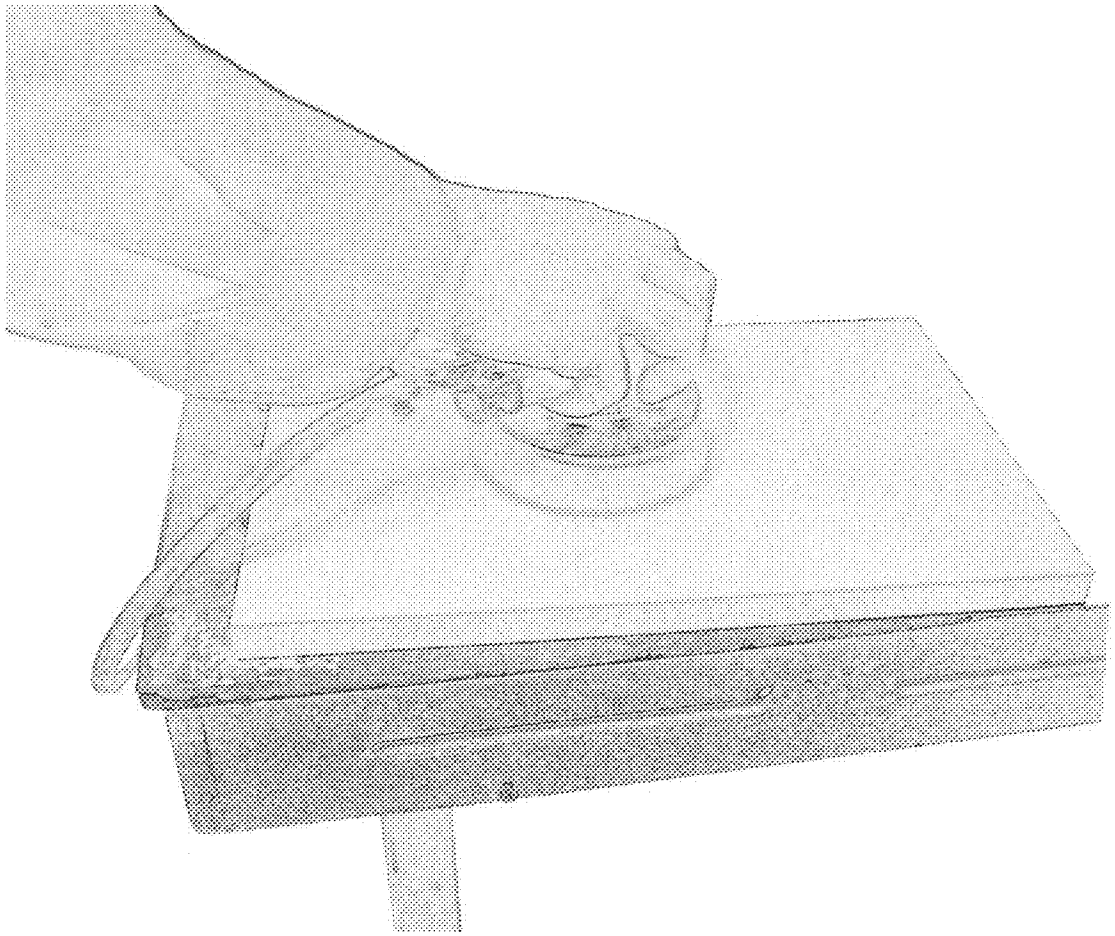
FIG. 6 illustrates the step of sanding the part with a random orbital hand sander in accordance with one embodiment of the invention.
Figure 8:
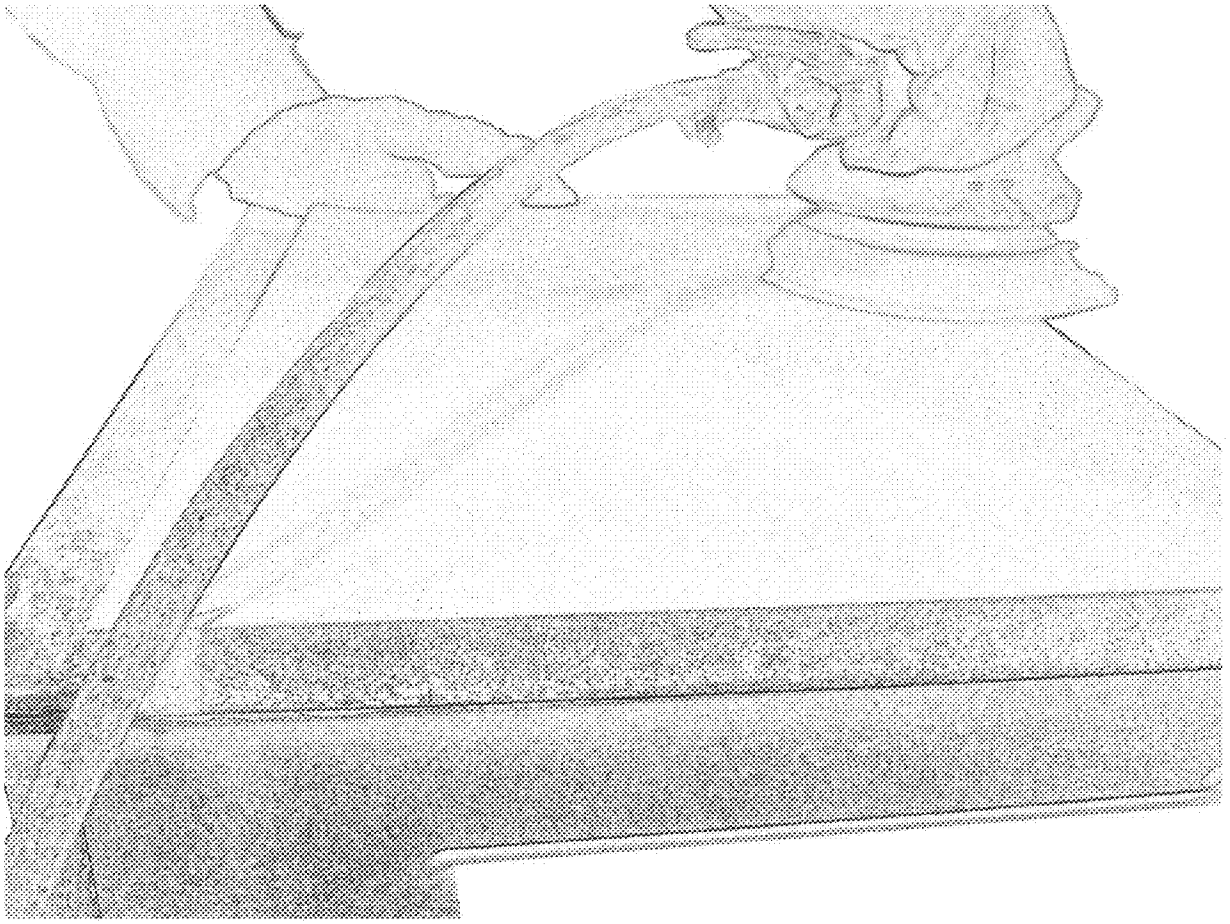
FIG. 8 illustrates a view of sanding the part with a random orbital hand sander wherein the sanding process is almost complete and the part is ready for application of the liquid top coat. There is no more visible orange peel.

Once the edges of the part have been sanded using the abrasive methods described herein, the face of the part are then ready to be sanded. In this step, the face of the component is sanded using an abrasive method as demonstrated in FIGS. 3, 6, and 8. The most common machinery employed is one (or a combination) of the following: a wide belt sander, a wide belt veneer segmented platen sander, a wide orbital machine sander, a random orbital hand sander. In a preferred embodiment, the method employs the wide belt veneer segmented platen sander and wide orbital machine sander operated in tandem. Abrasive grit size and sequence is important to this process and varies based upon the abrasive manufacturer and the specific sanding equipment being used. In a preferred embodiment, abrasives with a minimum of 15μ grit size should be used to accomplish proper buffing during the final buffing step. A diagram of preferred embodiment grit size and sequences for this step is set forth in FIG. 15, broken out by sanding equipment being used.

Figure 4:
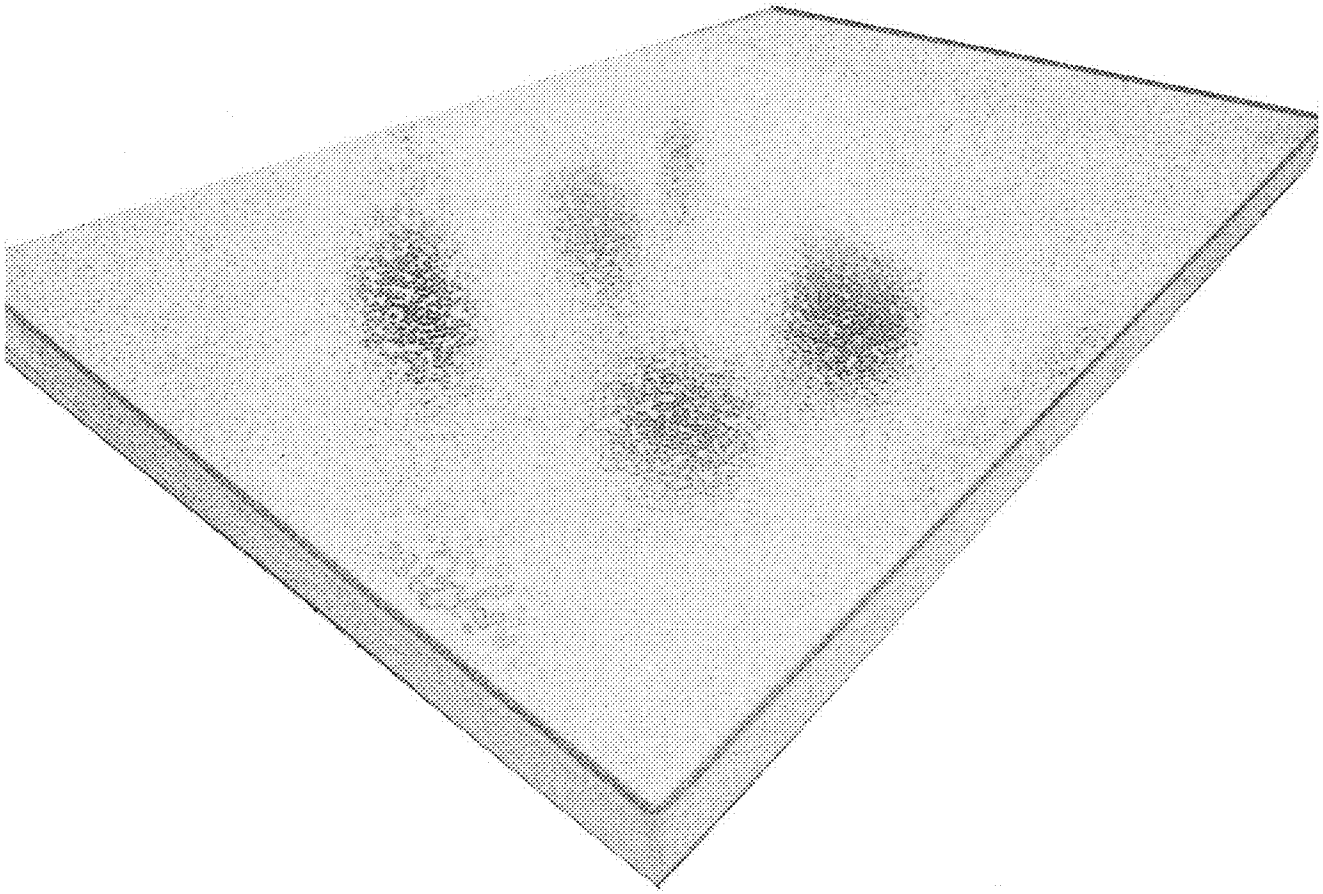
FIG. 4 illustrates orange peel, viewable at an angle, that has been partially sanded down after the wide belt, according to the invention.
Figure 5:
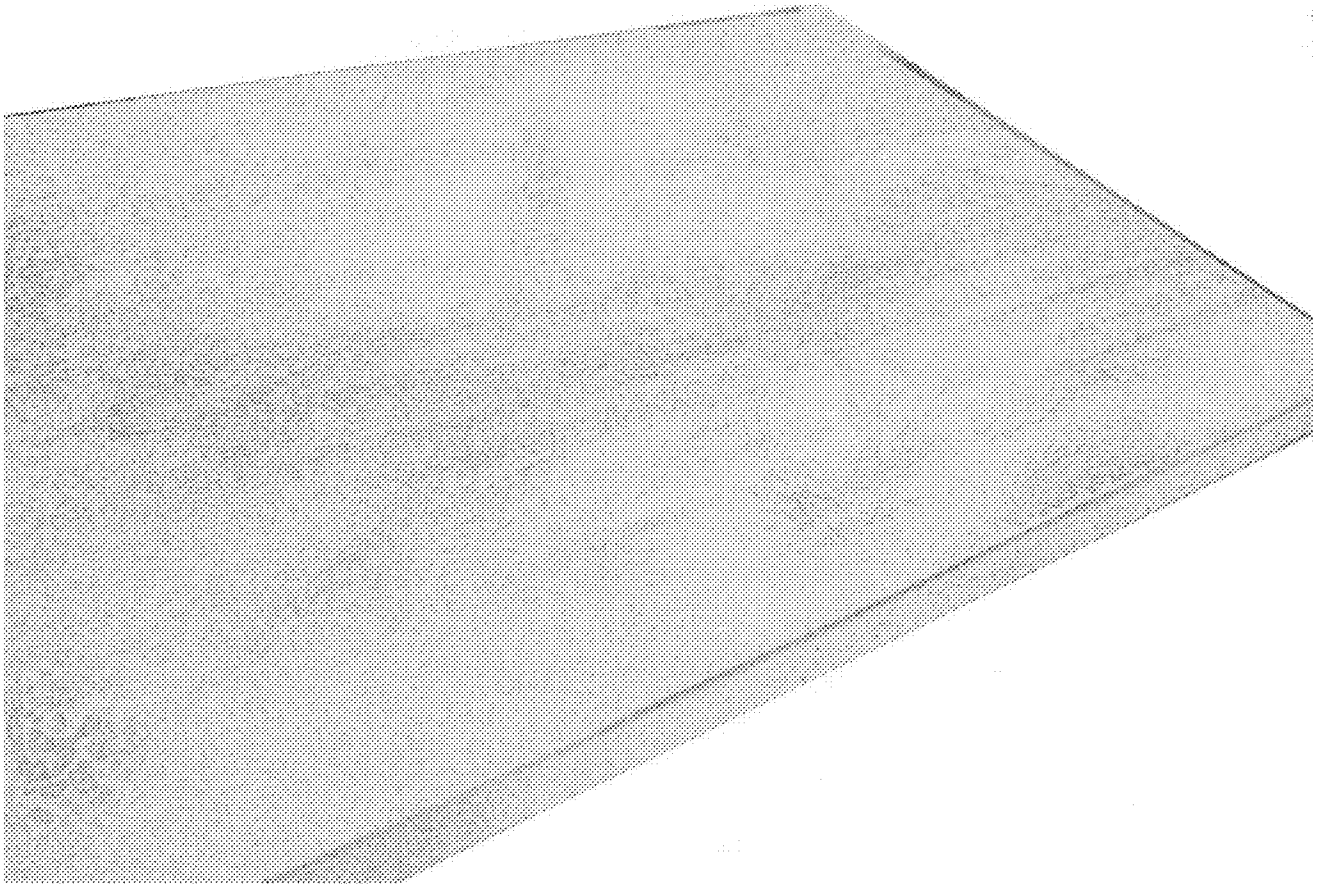
FIG. 5 illustrates another view of the sanded orange peel after the wide belt, according to the invention.

In a preferred embodiment, wide belt veneer segmented platen sanders with the Cross Belt Finish (CBF) technology are employed when sanding the face; this equipment is preferred because it results in the most reliable outcome with the least amount of fallout and required rework, as shown in FIGS. 4-5. This CBF technology is the preferred, but not the only, wide belt veneer segmented platen sander technology that will work for the present invention.

It is possible that a variety of other face and edge sanding equipment could be utilized while remaining within the scope of the invention, however the specific equipment listed herein has been tested for repeatable success. Further, it is possible to achieve a lesser quality finish (but still smoother than untreated powder coated MDF) using a variety of other abrasive equipment, grits, sequences, and process order changes (such as sanding the face before the edges). For example, using coarser abrasive grits will leave minute scratches in the finish; these minute scratches are considered a failure, although the finish may still be smoother than the untreated powder coated part. Conversely, PCI smoothness of 9-10 with no scratches or failures is routinely and reliably attainable using the method described herein.

Figure 9:
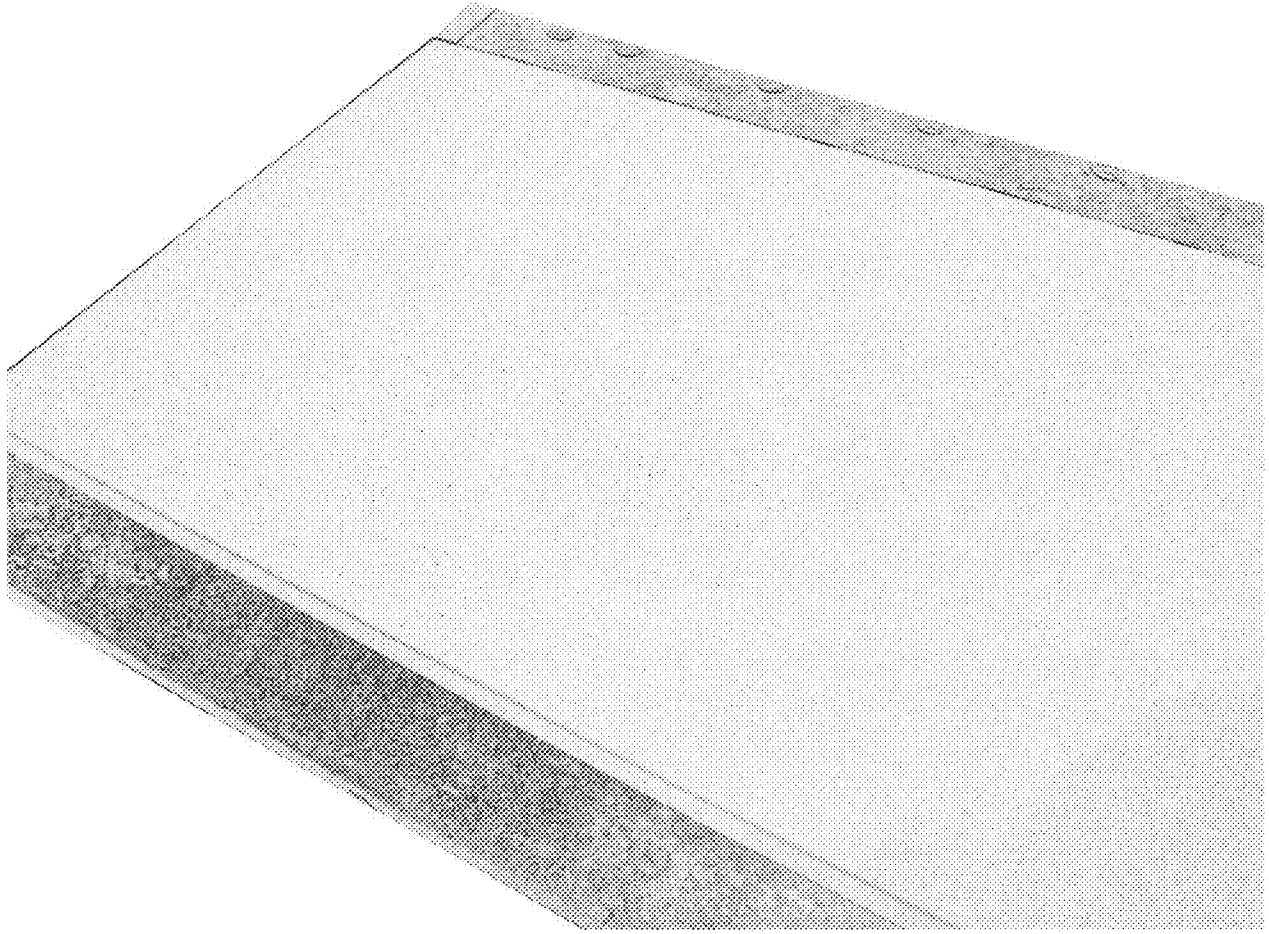
FIG. 9 illustrates a view of the part after sanding is complete and ready for buffing.
Figure 10:
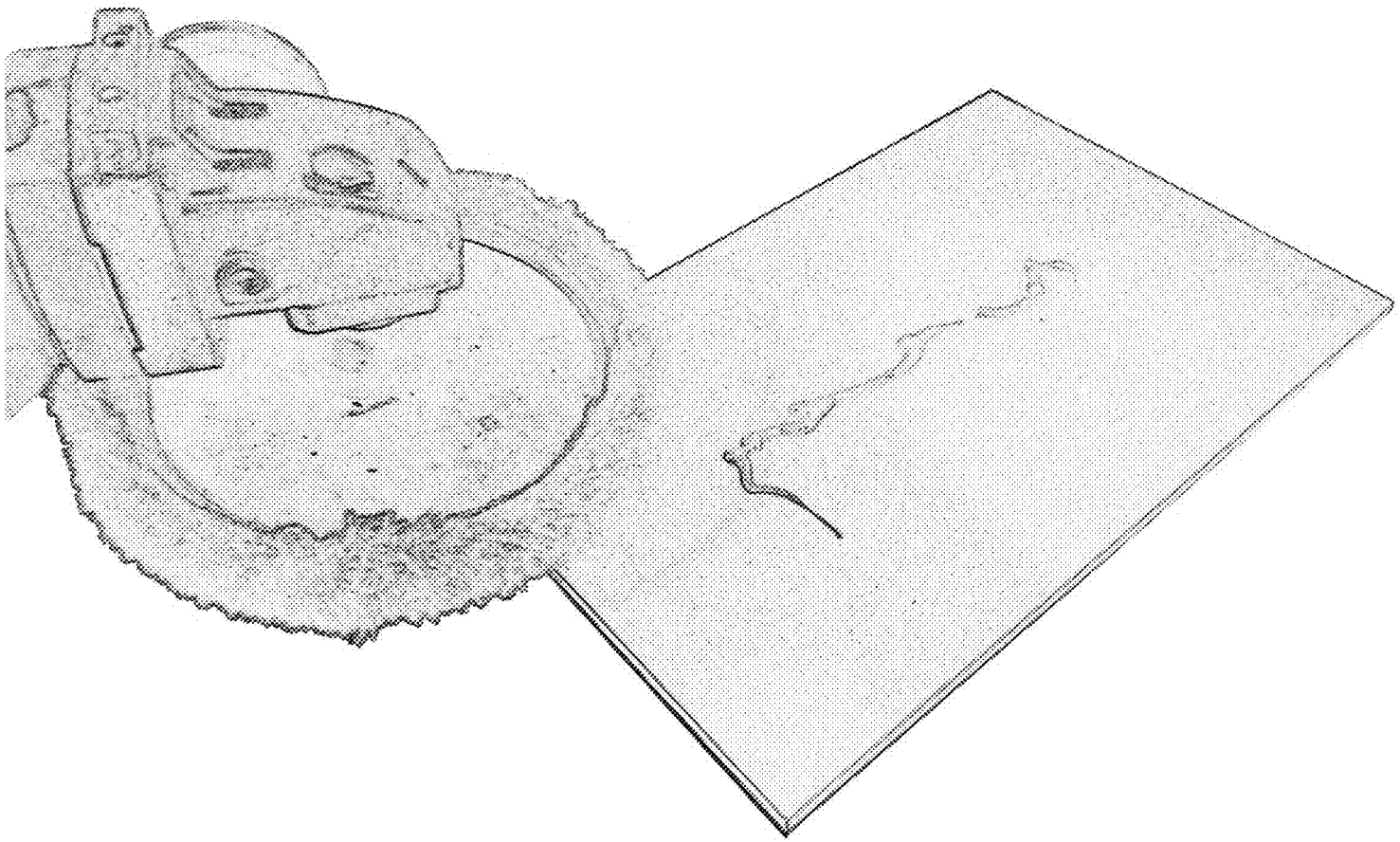
FIG. 10 illustrates a view of the part with buffing compound applied, about to be buffed with a rotary buffer.
Figure 11:
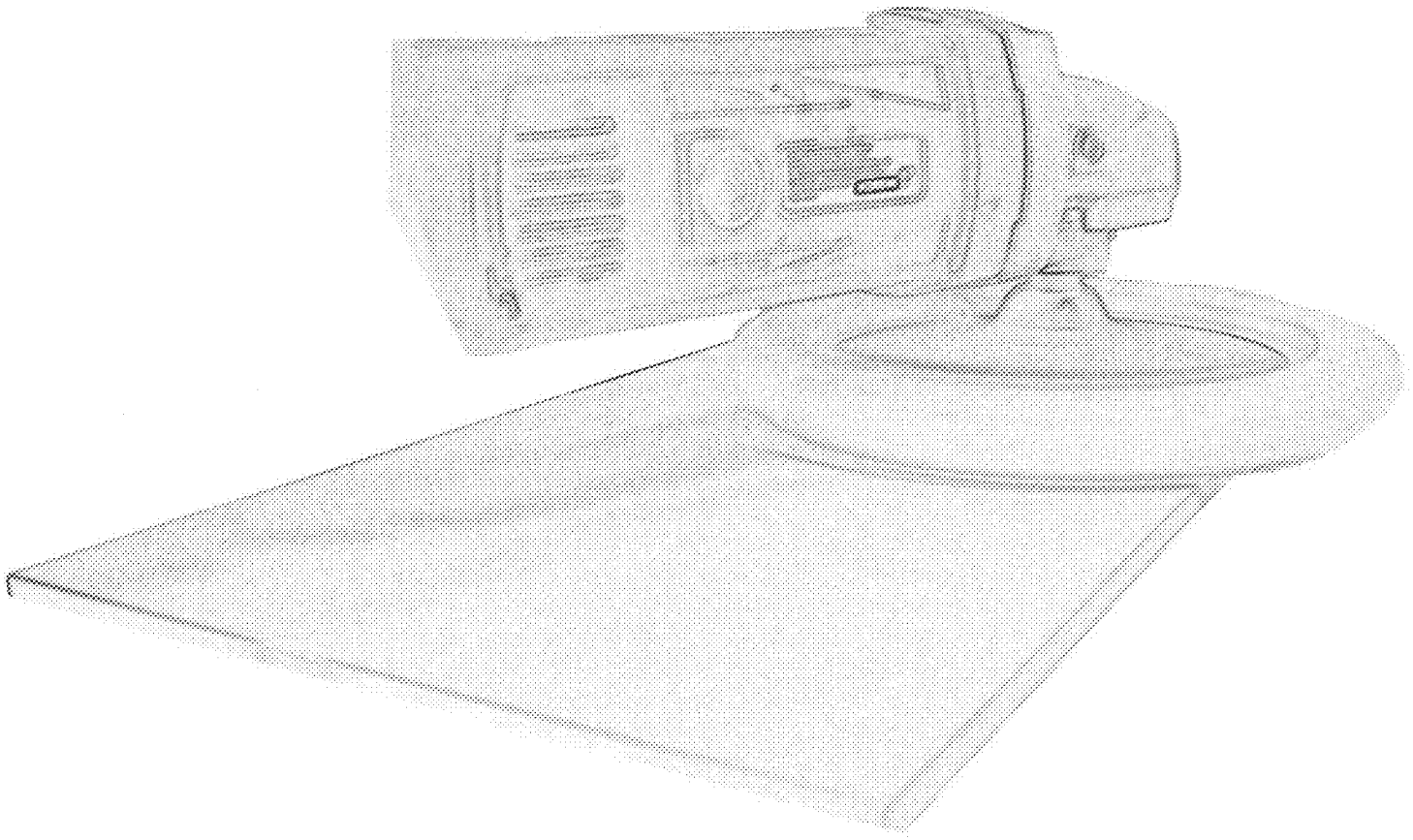
FIG. 11 illustrates a view of the part during the buffing process employing a rotary buffer. All surface orange peel has been removed and final smoothness is evident.

Once the face and edges achieve the desired smoothness as shown in FIG. 9, the part is ready for the final buffing step. The final buffing step as shown in FIGS. 10 and 11 will now be discussed. First, a small amount of rubbing compound is applied to the surface of the part. Next, the face of the part is buffed until all visible surface scratches left by abrasives have been removed. In order to remove any residual rotary buffing residue, a small amount of polish is applied to the part, and the polish is buffed using a polishing pad. In a preferred embodiment, the equipment and supplies used are in accordance with those set forth in FIG. 16.

Once the face of the part has been buffed through the steps described herein, the edges of the part can be buffed. First, a small amount of rubbing compound is applied to the edges. Next, the edges are buffed using buffing equipment until all visible abrasive scratches have been removed. In order to remove any residual rotary buffing residue, a small amount of polish is applied to the part and the polish is buffed using a polishing pad. In a preferred embodiment, the equipment and supplies used are in accordance with those set forth in FIG. 17.

The preferred embodiment of this invention describes specific buffing products and buffing equipment. However, similar results can be achieved with other buffing products and buffing equipment while still remaining within the scope of the invention; furthermore, the order in which the part is buffed (faces before edges or vice versa) and whether certain parts of the component are left without buffing (such as the back side) is immaterial to the invention as described.

Buffing processes applied to powder coated MDF, without first employing the specific treatments outlined in this application, would result in inferior outcomes dependent on the steps omitted. Following are some examples of outcomes when omitting one of the steps outlined in this application:

- Omitting the step of pre-powder sanding can cause the post-powder buffing to expose surface contamination, resulting in a speckled surface lacking uniform color properties. This surface contamination is caused mainly by residual surface imperfections on the surface of the MDF that are otherwise removed by proper sanding as described herein.
- Omitting the step of post-powder sanding (while still performing pre-powder sanding) will cause the buffing process to simply make the surface shinier, without increasing surface smoothness. This is because the post-powder sanding serves to remove surface roughness ("orange peel"), and the buffing step restores the integrity of the cured finish.

Conversely, simply sanding the powder coated MDF part without buffing the surface will result in a "chalky", delicate finish that does not have the uniform reflective characteristics of the final buffed finish. Furthermore, a wide variety of abrasive grit numbers and sequences have been tested; those grit numbers and sequences not outlined in this application either result in lesser smoothness ratings or result in a coating failure. The only known method to reliably improve PCI smoothness of a powder coated MDF finish without applying further top coat(s) is to follow the pre- and post-coating steps as well as the abrasive grit number and sequences outlined in this document.

EXAMPLE 1

A sheet of powder coat grade MDF is cut by a CNC router with new condition solid carbide tooling into a rectangle with dimensions of 12"W, 18"L, 0.75" thickness. Edge profiles are shaped to 1/16" radius; the faces and edges of the part are sanded with an automated sanding machine using the grit sequences and steps set forth in FIG. 14. The part is powder coated to a thickness of 8 mils using a white epoxy thermoset powder. At this point, the powder coated part has a PCI smoothness of 5-6.

After powder coating, the face of the coated part is sanded with a veneer segmented platen sander and wide orbital machine sander operated in tandem. An abrasive grit sequence is followed with the corresponding piece of equipment as represented in FIG. 15. The edges of the part are sanded with a profile sander, with an abrasive grit sequence followed in accordance with FIG. 15. The part is then wiped with a soft cloth and isopropyl alcohol.

After the above sanding sequences, the part is buffed using an 1800 RPM rotary buffer with a 3M Brand 82531 Finesse-it Buffing Pad and 3M Brand 06060 Perfect-it 3000 Extra Cut Rubbing Compound. The edges are buffed with a 3" 3M Brand 08125 air buffing tool with an orange foam buffing pad and 3M Brand 06060 Perfect-it 3000 Extra Cut Rubbing Compound. Finally, both the face and the edges are polished with a 3M Brand 05725 Perfect-it Foam Polishing Pad and 3M Brand Finesse-it Extra Fine Polish. The resulting part has a PCI smoothness of 10 and the visual depth comparable to a 5-coat wet sanded liquid paint finish.

COMPARATIVE EXAMPLE 1A

A sheet of powder coat grade MDF is cut by a CNC router with new condition solid carbide tooling into a rectangle with dimensions of 12"W, 18"L, 0.75" thickness. Edge profiles are shaped to 1/16" radius; the faces and edges of the part are sanded with an automated sanding machine using the grit sequences and steps set forth in FIG. 14. The part is powder coated to a thickness of 8 mils using a white epoxy thermoset powder. At this point, the powder coated part has a PCI smoothness of 5-6.

In this example the post-powder sanding steps are omitted and the part is taken straight to the buffing step. The part is buffed using an 1800 RPM rotary buffer with a 3M Brand 82531 Finesse-it Buffing Pad and 3M Brand 06060 Perfect-it 3000 Extra Cut Rubbing Compound. The edges are buffed with a 3" 3M Brand 08125 air buffing tool with an orange foam buffing pad and 3M Brand 06060 Perfect-it 3000 Extra Cut Rubbing Compound. Finally, both the face and the edges are polished with a 3M Brand 05725 Perfect-it Foam Polishing Pad and 3M Brand Finesse-it Extra Fine Polish. The resulting part is slightly shinier in appearance but the surface has an unchanged PCI smoothness of 5-6. The end goal of increasing PCI smoothness has not been achieved.

COMPARATIVE EXAMPLE 1B

A sheet of powder coat grade MDF is cut by a CNC router with new condition solid carbide tooling into a rectangle with dimensions of 12"W, 18"L, 0.75" thickness. Edge profiles are shaped to 1/16" radius; the faces and edges of the part are sanded using an automated sanding machine using the grit sequences and steps set forth in FIG. 14. The part is powder coated to a thickness of 8 mils using a white epoxy thermoset powder. At this point, the powder coated part has a PCI smoothness of 5-6. After powder coating, the coated part is sanded with a veneer segmented platen sander and wide orbital machine sander operated in tandem. An abrasive grit sequence is followed with the corresponding piece of equipment as represented in FIG. 15.

However, unlike example 1, this part is left without proceeding to the final buffing step. The resulting part has a PCI smoothness of 9-10; however, the finish is chalky, inconsistent in color, and has obvious surface scratches left by the abrasive equipment. It would not hold up to any end-product use without further surface treatment, and has no discernible finish depth. It would not be considered a salable end product.

While the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A method for treating a powder coated part to enhance visual and tactile smoothness, the method comprising the steps of:

a. Obtaining a part that is fabricated from a substrate containing wood;

b. Cutting and machining the part to a desired size utilizing equipment that has a tolerance that is less than +/−0.030";

c. Pre-powder preparation and sanding of the part by utilizing a sander to smooth the faces and edges of the part, whereby the sander has a Y-axis tolerance of less than 0.003", and wherein the edges are sanded to a minimum radius of 1/32" (0.8 mm);

d. Powder coating the part;

e. Post-powder preparation and sanding of the part to a PCI smoothness of at least 6 using an abrasive;

f. Buffing the part to achieve a PCI smoothness of at least 7.

2. The method of claim 1, wherein the equipment is selected from the group consisting of CNC routers, CNC point-to-point drilling/machining equipment, through feed molding machines, shapers, hand routers, panel saws, sliding table saws, and fixed table saws.

3. The method of claim 2, wherein the equipment machines the part with tooling fabricated from solid carbide.

4. The method of claim 2, wherein the equipment machines the part with tooling fabricated from high speed steel.

5. The method of claim 2, wherein the substrate containing wood is medium-density fiberboard.

6. The method of claim 2, wherein the substrate containing wood is high density fiberboard.

7. The method of claim 2, wherein the sander is selected from the group consisting of a wide belt sander, a wide belt veneer segmented platen sander, a wide orbital machine sander, a random orbital hand sander, or a combination thereof.

8. The method of claim 2, wherein the edge sanding equipment utilizes disks and profiled sanding heads.

9. The method of claim 2, wherein the step of pre-powder preparation and sanding of the part includes first sanding the part with a 220 grit aluminum oxide, silicon carbide media, then sanding the part with a 280 grit aluminum oxide, silicon carbide media, followed by sanding the part with a 320 grit aluminum oxide, silicon carbide media.

10. The method of claim 1, wherein the step of powder coating the part includes heating the substrate to a temperature of between 150 and 350 degrees F. to create an electrostatic charge, applying powder and allowing the powder to cure.

11. The method of claim 1, wherein the step of powder coating the part includes using a UV-cured powder coating process.

12. The method of claim 1, wherein the abrasive used during the post-powder preparation and sanding step has a minimum grit size of 15μ.

13. The method of claim 1, wherein the step of post-powder preparation and sanding of the part includes sanding the edges of the part using 400 grit aluminum oxide anti-static open coat media using a profile sander, then sanding the edges of the part using 30μ grit aluminum oxide anti-static open coat media using a profile sander, next sanding the edges of the part using 20μ grit aluminum oxide or silicon carbide anti-static open coat media using a profile sander.

14. The method of claim 13, wherein the step of post-powder preparation and sanding of the part includes sanding the faces of the part using P320 grit aluminum oxide anti-static open coat media with a wide belt veneer segmented platen sander, then sanding the faces of the part using P500 grit aluminum oxide anti-static open coat media with a wide belt veneer segmented platen sander, then sanding the faces of the part using 30μ grit aluminum oxide anti-static open coat or silicon carbide anti-static open coat media using a wide belt veneer segmented platen sander, then sanding the faces of the part using an aluminum oxide anti-static open coat media having a grit in the range of 30μ using a wide orbital machine sander, then sanding the faces of the part using an aluminum oxide anti-static open coat media having a grit of 20μ using a wide orbital machine sander, then sanding the faces of the part using an aluminum oxide anti-static open coat media having a grit of 15μ using a wide orbital machine sander.

15. The method of claim 1, wherein the step of buffing the part includes using a rotary buffer with a speed of 1800 revolutions per minute.

16. The method of claim 15, wherein the step of buffing the part further comprises using a polishing pad with extra fine polish.

17. The method of claim 16, whereby the step of buffing the part includes using rubbing compound.

18. A method for treating a powder coating a part to enhance visual and tactile smoothness, the method comprising the steps of:

a. Obtaining a part that is fabricated from medium-density fiberboard;

b. Cutting and machining the part to a desired size utilizing equipment that has a tolerance that is less than +/−0.030";

c. Pre-powder preparation and sanding of the part by utilizing a sander to smooth the faces and edges of the part, whereby the sander has a Y-axis tolerance of less than 0.003", and wherein the edges are sanded to a minimum radius of 1/32" (0.8 mm), and wherein the part is first sanded with a 220 grit aluminum oxide, silicon carbide media, then sanded with a 280 grit aluminum oxide, silicon carbide media, then sanded with a 320 grit aluminum oxide, silicon carbide media;

d. Powder coating the part, whereby the part is heated to a temperature between 150 and 350 degrees Fahrenheit to create an electrostatic charge, wherein powder is applied to the part and the part is then allowed to cure, resulting in a part that is coated with at least 5 mils of coverage about its surfaces and edges;

e. Post-powder preparation and sanding of the part using an abrasive having a minimum grit size of 15μ, whereby the edges of the part are sanded and whereby the faces of the part are sanded to a PCI smoothness of at least 7;

f. Buffing the part; whereby the part has a PCI smoothness of at least 7.

19. The method of claim 18, wherein, the step of buffing the part is achieved by using a rotary buffer with a speed of 1800 revolutions per minute.

* * * * *